US009499249B2

(12) United States Patent
Bowhay

(10) Patent No.: US 9,499,249 B2
(45) Date of Patent: Nov. 22, 2016

(54) PUMPING SYSTEM FOR TRANSPORTING FRESH WATER IN A SEAWATER ENVIRONMENT

(71) Applicant: Steven Clary Bowhay, Juneau, AK (US)

(72) Inventor: Steven Clary Bowhay, Juneau, AK (US)

( * ) Notice: Subject to any disclaimer, the term of this patent is extended or adjusted under 35 U.S.C. 154(b) by 203 days.

(21) Appl. No.: 14/588,852

(22) Filed: Jan. 2, 2015

(65) Prior Publication Data

US 2015/0197316 A1 Jul. 16, 2015

Related U.S. Application Data

(60) Provisional application No. 61/964,790, filed on Jan. 15, 2014.

(51) Int. Cl.

| | |
|---|---|
| ***B63B 22/26*** | (2006.01) |
| ***B63B 27/25*** | (2006.01) |
| ***B63J 1/00*** | (2006.01) |
| ***B63B 25/00*** | (2006.01) |

(52) U.S. Cl.

CPC ..... *B63J 1/00* (2013.01); *B63B 25/006* (2013.01); *Y10T 137/272* (2015.04); *Y10T 137/2877* (2015.04)

(58) Field of Classification Search

CPC ..... B63B 22/26; B63B 22/021; B63B 27/24; Y10T 137/206; Y10T 137/209; Y10T 137/593; Y10T 137/806; Y10T 137/807

USPC ..... 405/52, 75, 80, 127, 158, 171, 172; 441/4; 114/264; 137/593, 206, 209, 137/806, 807

See application file for complete search history.

(56) References Cited

U.S. PATENT DOCUMENTS

| | | | | |
|---|---|---|---|---|
| 2,854,049 | A | 9/1958 | Wyllie | |
| 3,236,267 | A * | 2/1966 | Bily | B63B 22/023 137/236.1 |
| 4,478,661 | A | 10/1984 | Lewis | |
| 4,506,623 | A | 3/1985 | Roper | |
| 4,802,431 | A * | 2/1989 | Pollack | B63B 22/021 114/230.13 |
| 5,657,714 | A | 8/1997 | Hsia | |
| 6,615,759 | B2 | 9/2003 | Yaffe | |
| 7,024,748 | B2 | 4/2006 | Eagles | |
| 7,029,348 | B2 * | 4/2006 | Bauduin | B63B 22/026 441/4 |
| 7,174,931 | B2 * | 2/2007 | Espinasse | B63B 22/021 141/387 |
| 7,377,492 | B2 | 5/2008 | Vrana | |
| 7,677,837 | B2 | 3/2010 | Pionetti | |
| 7,834,475 | B1 | 11/2010 | Costas | |
| 8,322,294 | B2 | 12/2012 | Bowhay | |
| 2008/0242165 | A1 * | 10/2008 | Adkins | B63B 22/021 441/4 |
| 2009/0097923 | A1 * | 4/2009 | Pionetti | B63B 22/021 405/169 |
| 2011/0116942 | A1 | 5/2011 | Duffy | |
| 2011/0155036 | A1 * | 6/2011 | Bowhay | B63B 35/44 114/256 |
| 2011/0229345 | A1 | 9/2011 | Konnur | |
| 2012/0020734 | A1 * | 1/2012 | Ross | E02B 9/00 405/75 |
| 2013/0014849 | A1 | 1/2013 | Glejbol | |

* cited by examiner

*Primary Examiner* — Benjamin Fiorello
*Assistant Examiner* — Stacy Warren
(74) *Attorney, Agent, or Firm* — Christensen O'Connor Johnson Kindness PLLC

(57) ABSTRACT

A fresh water transportation system is disclosed that takes advantage of the buoyancy of fresh water in salt water to transport fresh water through a body of salt water. The fresh water flows from an above-water vessel through a down pipe supported on the sea bed, and through a curved pipe that redirects the fresh water flow upwardly. In an embodiment a gas, for example air or natural gas, is injected into the fresh water in the upwardly directed portion of the flow. An inclined compliant pipe receives the upwardly directed flow, such that the hydrostatic pressure is communicated to the fresh water, whereby the fresh water is urged through the compliant pipe.

19 Claims, 4 Drawing Sheets

PUMPING SYSTEM FOR TRANSPORTING FRESH WATER IN A SEAWATER ENVIRONMENT

CROSS-REFERENCE TO RELATED APPLICATION

This application claims the benefit of Provisional Application No. 61/964,790, filed Jan. 15, 2014, the disclosure of which is hereby incorporated by reference in its entirety herein

BACKGROUND

Fresh water, although abundant, is often not located in sufficient quantity near population centers, agricultural production centers, or other users. For example, as population centers grow, and human populations become more geographically concentrated, local sources of potable water may be insufficient to accommodate the growing needs. Often, alternative sources of fresh water may need to be transported over intervening bodies of seawater.

The present inventor has disclosed an offshore fresh water reservoir system and method in U.S. Pat. No. 8,322,294, to Bowhay, which is hereby incorporated by reference in its entirety, wherein freshwater effluent may be captured and retained in a floating reservoir disposed in the ocean, for example. Advantages of such a system will be apparent to persons of skill in the art. For example, the system may be used to capture fresh water that would otherwise become mixed with ocean water. Also, the fresh water is retained in an offshore facility, thereby avoiding the costs of developing a land-based reservoir and preserving land space. It is contemplated that the offshore reservoir may provide a fresh water secondary reserve that may be used to replenish or maintain water levels in existing conventional reservoirs.

Shortages of fresh water, e.g., potable water and/or water for agricultural uses are being encountered more often due to demands from an increasing population, and the growing concentration of the population in large metropolitan areas. It has been estimated that by the year 2050, some four billion people will be facing sever water shortages. Such water shortages are not limited to underdeveloped countries. People living in southwestern states in the United States, for example, could be facing severe freshwater shortages by 2050, or even earlier. Although most of the Earth's surface is covered by water, less than two percent of the surface water is fresh water, i.e., water having relatively low concentrations of dissolved salts and other total dissolved solids. Shortages of fresh water are further compounded by waste and poorly managed water supplies.

A significant fraction of the human population is located near the ocean or other major bodies of salt water. Salt water is generally not potable, of course, although large quantities of fresh water regularly flow into seawater bodies. Typically, the availability of fresh water is seasonal, and seasonal water forecasting is an important undertaking for most water supply systems. During times of high water flow, fresh water may be abundantly available to fill local needs, but when the water flow drops off, severe fresh water shortages can occur. It would be useful to store fresh water, for example, river effluent from periods of high water flow, for use during times of low water flow.

Also, in certain regions near bodies of salt water and without an adequate fresh water source, water desalination plants are used to extract fresh water from the salt water body. In order to run the desalination plants at peak efficiency, while ensuring a stable supply of fresh water, it is desirable to have a reservoir to temporarily store the fresh water that is produced, for purposes of load leveling and to accommodate periods of equipment maintenance, for example.

However, there remains the problem of efficiently and reliably transporting fresh water, for example, fresh water stored in off-shore reservoirs or fresh water located a distance from the users. Fuel gasses, such as methane or natural gas, are also often available in significant quantities in sea beds. Such fuel gasses may also need to be efficiently transported long distances to be available to end users. In certain aspects of the disclosed invention, both water and gasses may be beneficially and efficiently transported together.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A system for transporting fresh water through a saltwater environment is disclosed. In one embodiment it includes a first fresh water reservoir disposed in or near a body of salt water. A rigid down pipe extends downward from the reservoir to a curved pipe that receives fresh water and turns the water to an inclined flow. A compliant pipe is connected to receive the flow of fresh water from the curved pipe, whereby external hydrostatic pressure is communicated to the flow through the compliant pipe. A gas injection system injects gas into the inclined flow increasing the buoyancy of the flow. Spaced-apart supports retain the compliant pipe along a pipe to maintain an upwardly oriented flow through the salt water body, and the flow is directed to a second fresh water reservoir.

In an embodiment, the injected gas is air or natural gas.

In an embodiment the source reservoir floats in the body of salt water and comprises a peripheral wall with a floating interface assembly that separates the fresh water from the salt water.

In an embodiment the upper end of the down pipe defines an elevated vessel disposed in or over the first reservoir, and the system further includes a pump for pumping fresh water into the elevated vessel.

In an embodiment a controllable valve is configured to control the flow of fresh water into the down pipe.

In an embodiment the compliant pipe is at least one mile long, and the support structures include anchored cables that engage the compliant pipe and optionally include buoys that are fixed to an end of the anchored cables. The supports may be configured to maintain an average angle of inclination in the compliant pipe of at least three degrees along the length of the compliant pipe.

A fresh water transportation system for transporting fresh water through a salt water environment is disclosed. The system includes (i) a fresh water reservoir, (ii) a first transfer station located in a body of salt water comprising a first vessel configured to receive fresh water from the reservoir, a first down pipe having one end connected to receive fresh water from the first vessel and another end fluidly connected to a first curved pipe that turns the downward flow to an inclined flow direction, and a first compliant pipe that receives the flow such that external hydrostatic pressure is communicated to the flow, and (iii) a second transfer station located in a body of salt water comprising a second vessel configured to receive fresh water from the first compliant pipe, a second down pipe having one end connected to receive fresh water from the second vessel and another end fluidly connected to a second curved pipe that turns the downward flow to an inclined flow direction, and a second compliant pipe that receives the flow such that external hydrostatic pressure is communicated to the flow.

In an embodiment a gas injection means to inject gas into the first curved pipe or into the first compliant pipe. In an exemplary embodiment the injected gas is air or natural gas.

In an embodiment the system further includes a compressor disposed above the body of salt water that is fluidly connected to inject gas through a plenum. The first curved pipe includes a plurality of apertures, and a compressor is disposed above the surface of the salt water body, and the plenum injects compressed gas into the curved pipe through the apertures. In an exemplary embodiment the compressor is powered by the flow of the fresh water received by the first vessel.

In an embodiment, natural gas is injected into the fresh water flow.

In an embodiment the compliant pipe is supported by a plurality of spaced-apart support structures, to maintain an average inclination angle of at least three degrees over a distance of at least one mile.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A fresh water transportation system is disclosed that is scalable, and is suitable for efficiently transporting large quantities of fresh water through a seawater environment. The disclosed systems take advantage of the fluid dynamics associated with buoyant flows, and optionally buoyant multiphase flows. The invention will be described with reference to particular, currently preferred embodiments that illustrate various aspects of the invention to aid persons of skill in the art with understanding the invention. The invention is not restricted to details of the disclosed embodiments. It will be appreciated to persons of ordinary skill in the art that in general the features of one embodiment may be practiced in the other embodiments.

Figure 1:
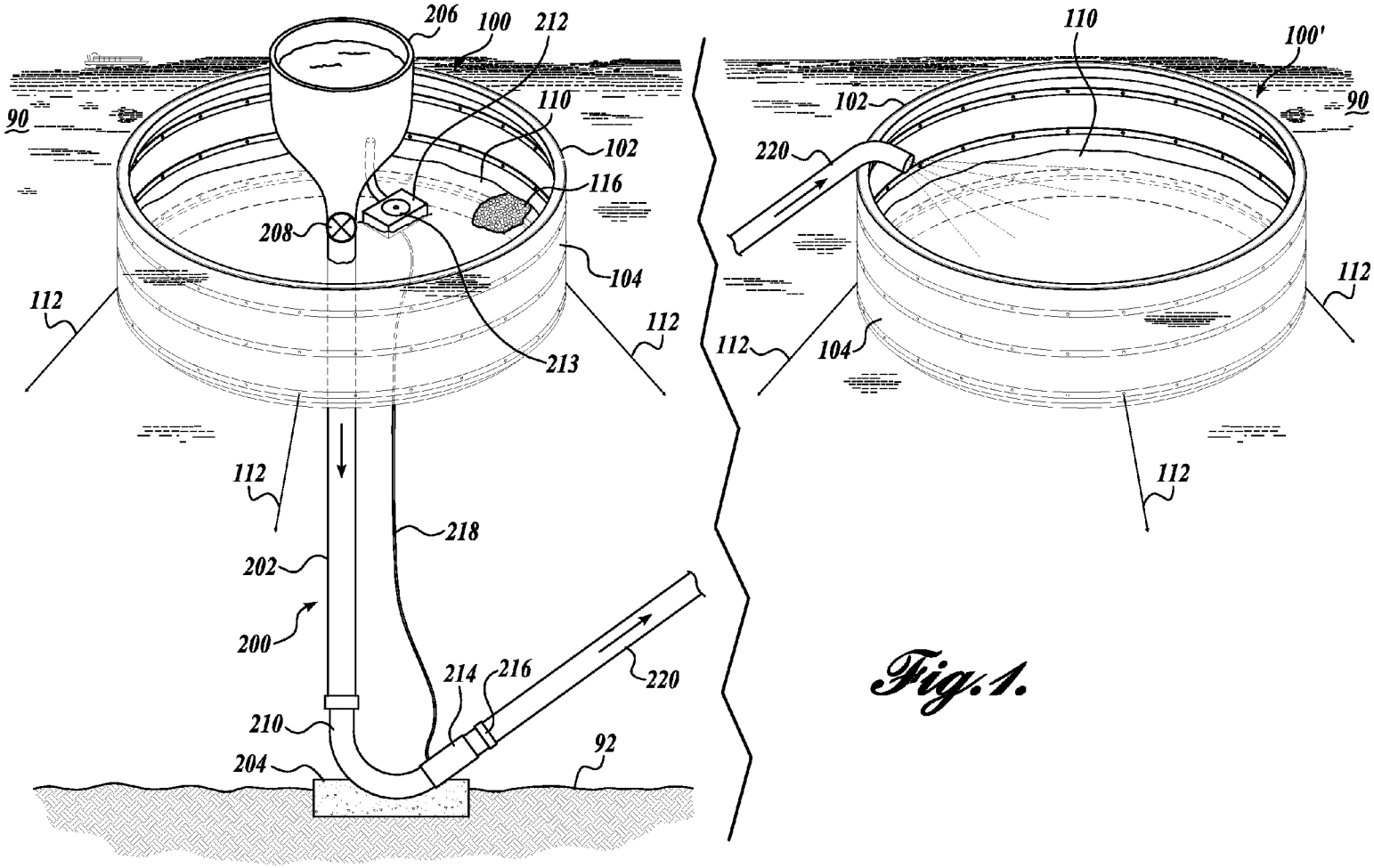
FIG. 1 is an environmental view of a fresh water transportation system in accordance with the present invention, and configured to transport fresh water from an offshore fresh water reservoir to a distant user, for example, a second offshore fresh water reservoir.

In a first embodiment illustrated in FIG. 1, and which may be advantageously practiced with the offshore fresh water reservoir disclosed by the present inventor in U.S. Pat. No. 8,322,294, a fresh water transportation system 200 is configured for transporting fresh water from a first offshore reservoir 100 floating in a seawater body 90 to a distant receiver, in this example, a second offshore reservoir 100'.

In this exemplary embodiment, the first offshore reservoir 100 has an upper flotation portion 102 that extends above the waterline and a pliable downwardly extending skirt 104 that extends into the seawater 90. The floatation portion 102 may be an annular polymeric foam tube enclosed in a saltwater resistant covering, for example. Alternatively, the floatation portion 102 may be built as a more rigid structure, for example, a rigid or semi-rigid polymeric skeletal support enclosed in an outer shell or skin. A covering or dome enclosure (not shown) may optionally be provided to prevent or reduce salt water or other foreign debris from encroaching into the reservoir 100.

As described in Bowhay, water contained in the reservoir 100 floats on the seawater 90, and is separated from the seawater 90 by a floating interface assembly 110, for example, a closely packed plurality of buoyancy members 116 that provides a self-locating barrier between the relatively low-density fresh water and the relatively high-density seawater. The reservoir 100 is anchored at a desired location with anchor cables 112. It is contemplated that the reservoir 100 may be very large. In exemplary embodiments, the reservoir 100 has a capacity in the range of 10^7 to 10^10 cubic meters, or more.

The fresh water transportation system 200 includes a substantially vertical and rigid down pipe 202 positioned or configured to receive fresh water from the first reservoir 100 using the fresh water transportation system 200. The down pipe 202 extends downwardly from the first reservoir 100 to a support structure 204 fixed to the seabed 92.

In the currently preferred embodiment, the down pipe 202 extends upwardly into the first reservoir 100 and supports an elevated chamber or vessel 206. The elevated vessel 206 extends above the waterline of the fresh water in the reservoir 100. Water stored in the reservoir 100 is pumped into the vessel 206 with a utility system 212 with a pump/compressor 213, control system, and power supply. For example, it is contemplated that a wave-powered pump (not shown) may be used as a power supply.

A conventional, controllable valve 208 may be provided in the down pipe 202 to selectively control the flow of fresh water to the down pipe 202. For example, flow may be initiated with the flow from the elevated vessel 206 to take advantage of the additional pressure available from the elevated water. After the flow is initiated, the valve 208 may be set to permit flow directly from the main volume of the reservoir 100. The flow may be stopped as necessary by closing the valve 208.

The lower end of the down pipe 202 comprises or is connected to a curved pipe 210 that turns the flow in the down pipe 202 such that the flow is transitioned to an inclined flow direction. For example, the curved pipe 210 may turn the flow any amount more than ninety degrees. The distal portion of the inclined leg of the curved pipe 210 has a plurality of apertures 203, to permit gas to be injected into the fresh water flow, as discussed below. A gas injection system 216, for example a pressurized air plenum, is configured to inject gas into the curved pipe 210 through the apertures 203 (see FIG. 2).

The distal end of the curved pipe 210 is connected to a collapsible or compliant pipe 220. The compliant pipe 220 transmits the external pressure from the body of seawater 90 directly to the fresh water in the compliant pipe 220. Compliant pipes are known in the art. See, for example, U.S. Pat. No. 4,478,661, to Lewis, which is hereby incorporated by reference. See also U.S. Patent Application Publication No. 2013/0014849, to Glejbol, which is also hereby incorporated by reference. For example, the compliant pipe 220 may be collapsible to a flat configuration during deployment, and opened by the flow of a fluid therethrough during operation.

Figure 2:
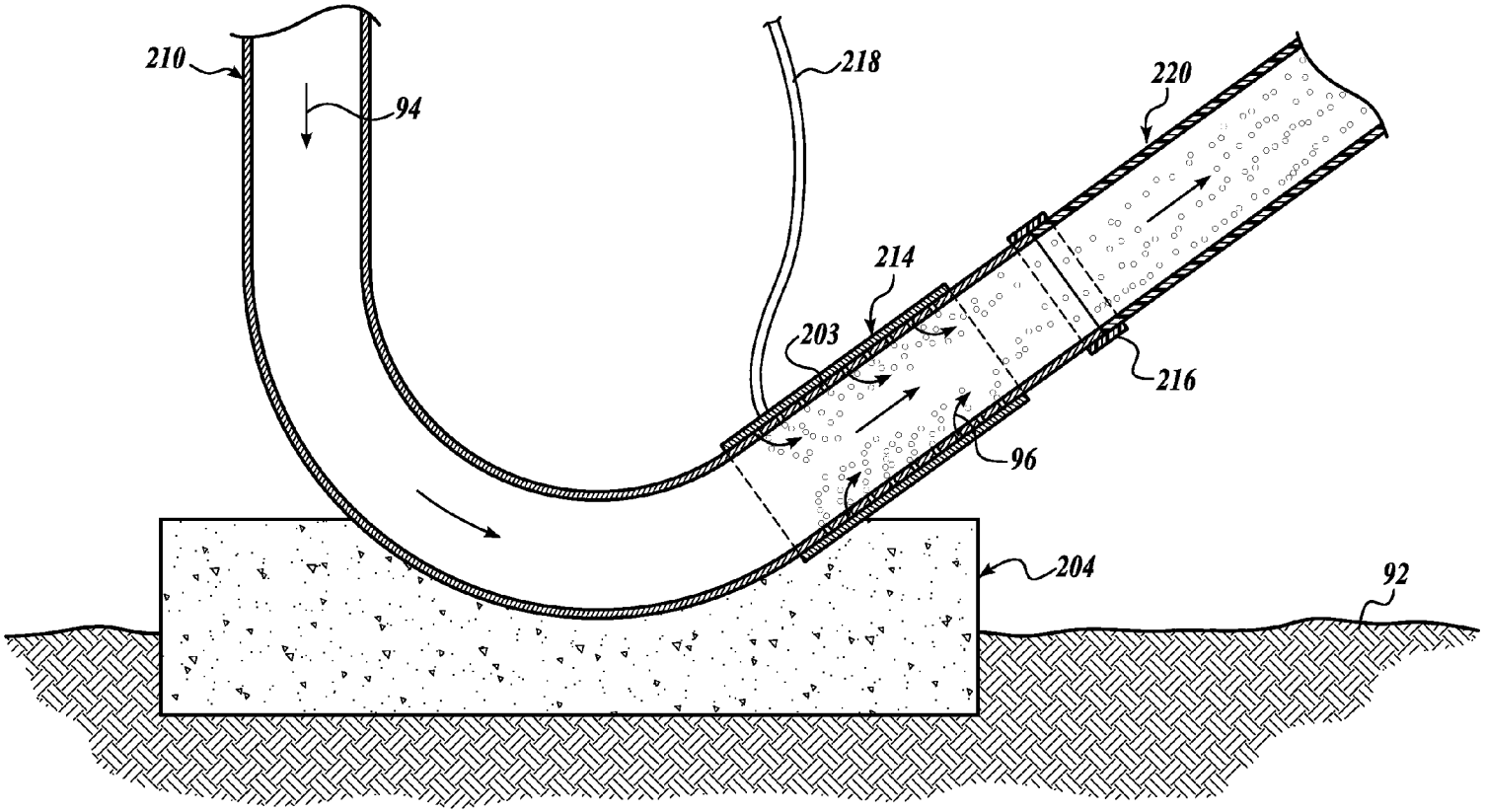
FIG. 2 illustrates a lower portion of the fresh water transportation system shown in FIG. 1, including a gas injection system.

FIG. 2 illustrates generally a sectional view of the curved pipe 210, gas injection plenum 214, and lower end of the compliant pipe 220, with the fresh water flow indicated by the arrows 94. Fresh water from the down pipe 202 enters the curved pipe 210 downwardly. Because the down pipe 202 is not otherwise pressurized, the hydraulic head or pressure of the fresh water will depend on the height of the water column and the density of the fresh water. The curved pipe 210 turns the downward flow of the fresh water to an inclined flow direction. On the inclined portion of the curved pipe 210, a gas injection plenum 214 injects pressurized gas into the fresh water through the apertures 203, as indicated by arrows 96. In this embodiment, the pressurized air is provided through a conduit 218 connected to the compressor 213 or other compressed gas source on the utility system 212.

In an alternative embodiment, natural gas or methane is scavenged from seabed seepage or from an underwater well. For example, it is contemplated that a collection tent may be provided over natural underwater methane seepage areas to collect natural gas, which may then be compressed and injected into the fresh water inclined flow. The natural gas production may be increased, if necessary, for example using known drilling methods. The compressed natural gas is injected into the fresh water flow rather than air, thereby permitting fresh water and natural gas to be transmitted together to a distant location. The natural gas will separate from the fresh water at the destination, e.g., at the second fresh water reservoir 100', where it may be recovered for further processing or use.

The compliant pipe 220 is connected to the curved pipe 210 with a suitable conventional pipe coupling 216, as is known in the art. Compliant piping is readily deployable over long distances. For example, the compliant pipe 220 may be obtained in long sections that are packaged on reels, wherein the pipe is unreeled and deployed from the back of a suitable watercraft. The compliant pipe 220 is intermittently supported to achieve a desired angle of inclination. For example, support structures may be provided that extend from the seabed or from buoy-supported supports.

The compliant pipe 220 is deployed and installed between the first reservoir 100 and the second reservoir 100' with an average angle of inclination that is preferably selected based on the distance that the water is to be transported (i.e., the distance between the reservoir 100 and the destination) and the length of the down pipe 202. It is contemplated that this distance in some embodiments may be between 1 and 100 miles. For example, if the down pipe 202 extends two miles below the reservoir 100 to the seabed floor, and the second reservoir 100' is one hundred miles from the first reservoir 100, the average angle of inclination for the compliant pipe 220 will be about 1.15 degrees.

The compliant pipe 220 may be supported at a selected inclination using any suitable support system. In a current embodiment, a plurality of support stations are installed in spaced-apart locations between the first reservoir 100 and the second reservoir 100'. The support stations 230 are configured to support the compliant pipe 220 at a selected elevation to produce a desired angle of inclination along the length of the pipe 220.

Figure 3:
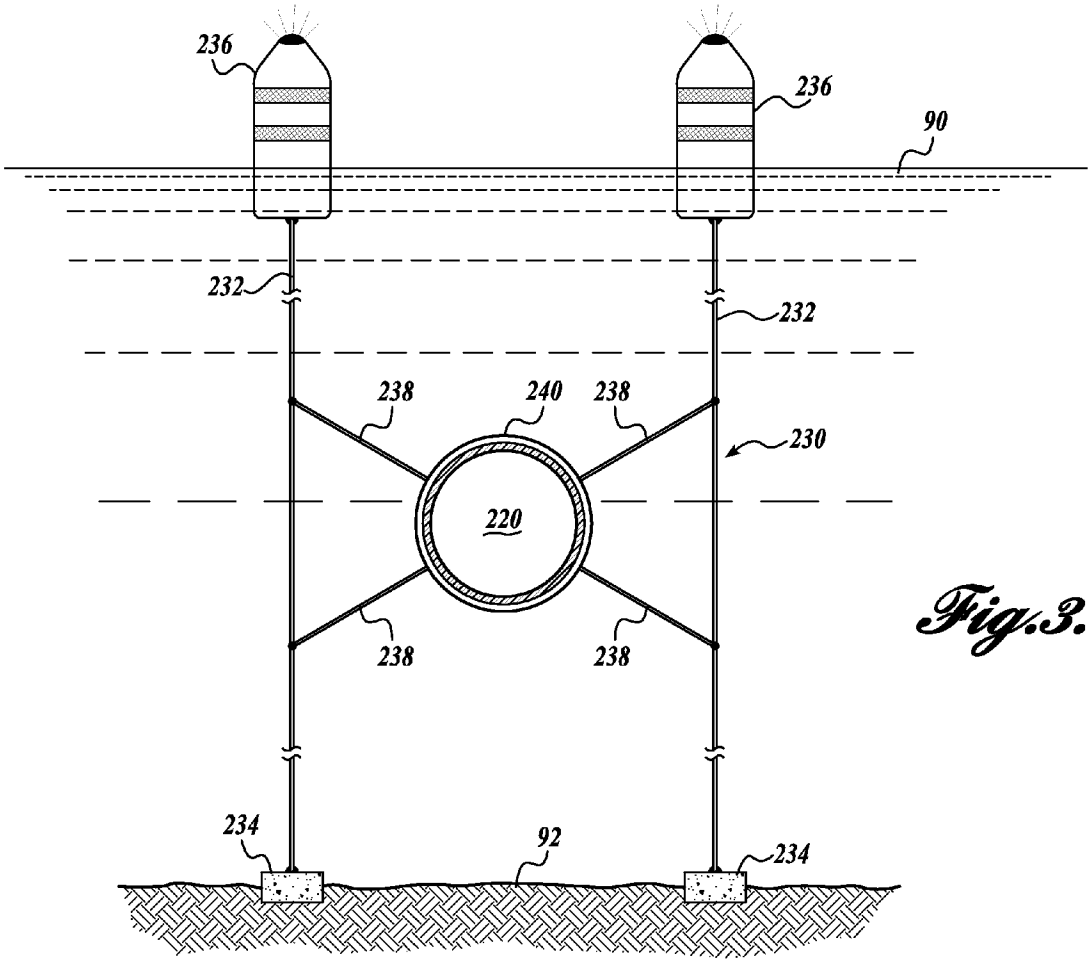
FIG. 3 illustrates an exemplary support station for supporting the compliant pipe of the fresh water transportation system shown in FIG. 1 at a particular location, wherein a number of the support stations maintain the compliant pipe at a desired inclination.

An exemplary support station 230 is illustrated in FIG. 3. The support station 230 includes at least two cables or lines 232 that are oriented vertically in the body of water 90. The lines 232 in this embodiment are anchored to the seabed 92 with anchors 234, and are supported in a vertical orientation by buoys 236. The buoys 236 may be configured to float on the surface of the body of water 90, or may be disposed below the surface. Support cables 238 are fixed to the lines 232 at a vertical location that is selected to achieve a desired elevation for the compliant pipe 220. In a particular embodiment, a collar or sleeve 240 wraps around the compliant pipe 220 and includes connectors (not shown) for attaching the cables to the sleeve 240. Although two buoys 236 and two anchors 234 are shown, it will be apparent that a single buoy and anchor, or more than two buoys and/or more than two anchors, may alternatively be used.

Use of the fresh water transportation system 200 will now be described. In the embodiment shown in FIGS. 1 and 2, fresh water from the first reservoir 100 is pumped from the first reservoir 100 into the elevated vessel 206. Alternatively, it is contemplated that the elevated vessel 206 may not be required. When initiation of a flow of fresh water is desired, the controllable valve 208 is opened such that water flows from the elevated vessel 206 and through the rigid down pipe 202, and through the curved pipe 210. Pressurized gas is injected into the inclined portion of the curved pipe 210. The injected gas reduces the average density of the fluid in the curved pipe 210, thereby increasing the buoyancy force on the flow in the pipe.

The flow continues into the compliant pipe 220. It will be appreciated that fresh water is lower in density than salt water, and the density of the fresh water/gas mixture is even lower in density than fresh water alone. Therefore, buoyancy forces will cause the fresh water/gas mixture to continue to rise in the compliant pipe 220. In the embodiment of FIG. 1, the distal end of the compliant pipe 220 is positioned to deposit the flowing water into the second fresh water reservoir 100'.

It will be apparent to persons of skill in the art that the distal end of the compliant pipe 220 may alternatively be directed to a different end user or storage system. For example, the disclosed fresh water transportation system may deliver water to a land-based reservoir, to an irrigation system, or the like. In particular, the buoyancy advantages from injecting a gas in the lower end of the compliant pipe 220 will allow the fresh water to be delivered at a significant elevation. It is contemplated, for example, that the fresh water may be transported to a land-based reservoir. Therefore, the elevated fresh water will have large potential energy that may be used for power generation.

The fresh water reservoir 100 or 100' may comprise a plurality of reservoirs with conventional means for distributing the fresh water between the reservoirs. In a particular application, the fresh water reservoir 100 may be located near a desalination plant to provide storage for the water produced and transportation of the water to an end user.

Figure 4:
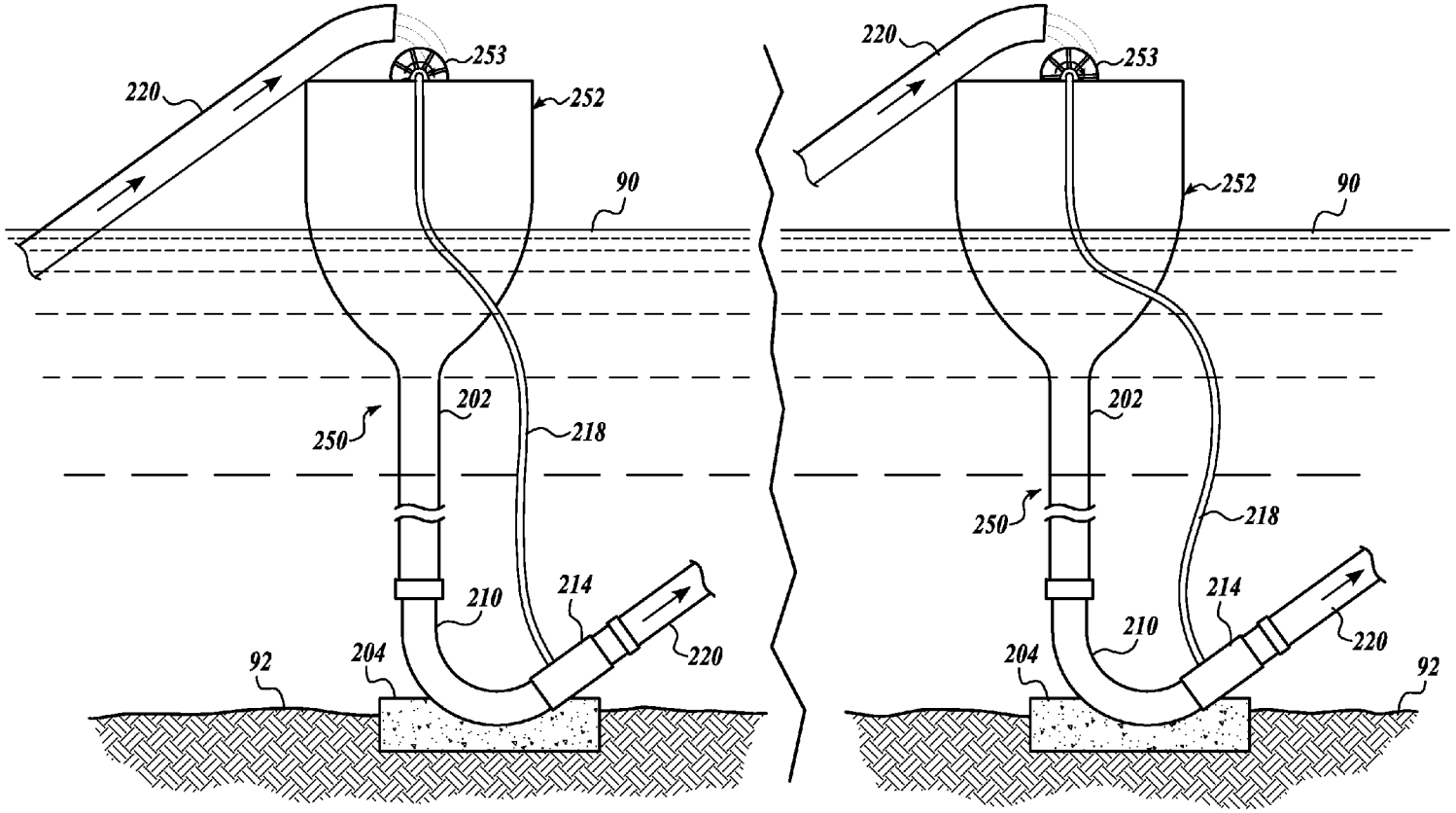
FIG. 4 illustrates a second embodiment of a fresh water transportation system in accordance with the present invention that includes one or more relay stations that receive fresh water form a source and transports the fresh water through a salt water environment.

The present invention may be used to transport fresh water longer distances using a series of relay stations 250, as illustrated in FIG. 4. The individual relay stations 250 may be similar to the fresh water transportation system 200 illustrated in FIG. 1, but without the large reservoir capacity. Aspects of the relay stations 250 that are similar to the transportation system 200 described above have similar identifiers, and will not be reiterated in detail, for efficiency and ease for the reader. In this embodiment, a fresh water relay station 250 receives fresh water from a source. For example, the fresh water may be received from a fresh water reservoir 100 using a system such at the transportation system 200 described above. Alternatively, the fresh water may be received by the relay station 250 or from any other source.

In this embodiment, a transfer vessel 252 is supported on a rigid down pipe 202, providing a flow conduit from the transfer vessel 252. Optionally, the received water may be provided at an elevation above the transfer vessel or with sufficient velocity to drive a compressor 254 disposed in the transfer vessel 252. The lower end of the down pipe 202 is connected to a curved pipe 210 that turns the flow at least ninety degrees. The down pipe 202 and curved pipe 204 are supported by a support structure 204 on the seabed 92. A gas injection plenum 214 is configured to inject a gas, for example, air or scavenged natural gas, into the curved pipe 204. The curved pipe 204 is connected to a compliant pipe 220 that extends at an inclined angle towards a next relay station 250 and is intermittently supported to maintain the desired inclination angle.

Due to the buoyancy of the fresh water/entrained gas flow arriving at the transfer vessel 252, the water can be delivered at an elevation and with significant velocity. It is contemplated that the transfer vessel may be provided with a water wheel powered compressor 253 to power a compressor for the gas injection system 214.

Although in the currently preferred embodiment the gas injection system 214 is configured to inject gas into the curved pipe 210, it will be appreciated that the gas may alternatively be injected downstream of the connector 216 into the compliant pipe 220.

While illustrative embodiments have been illustrated and described, it will be appreciated that various changes can be made therein without departing from the spirit and scope of the invention.

The embodiments of the invention in which an exclusive property or privilege is claimed are defined as follows:

1. A system for transporting fresh water long distances through salt water comprising:

a first reservoir containing fresh water disposed in or near a salt water body;

a substantially rigid down pipe having an upper end configured to receive a flow of fresh water from the first reservoir, and a lower end disposed below the surface of the salt water body;

a curved pipe having a downwardly oriented proximal portion that is connected to receive the flow of fresh water from the lower end of the down pipe, and an inclined distal portion such that the flow of fresh water from the down pipe is turned by the curved pipe from a downward flow to an inclined flow;

a compliant pipe fluidly connected to receive the flow of fresh water from the curved pipe, wherein external hydrostatic pressure is communicated to the flow of fresh water through the compliant pipe;

a gas injection system configured to inject a gas into the inclined distal portion of the curved pipe or into a proximal portion of the compliant pipe;

a plurality of spaced-apart support structures configured to support the compliant pipe along a length of the compliant pipe, such that the length of the compliant pipe is disposed at an upwardly angled orientation in the salt water body; and a second reservoir for fresh water disposed a distance from the first reservoir and positioned to receive the flow of fresh water from a distal end of the compliant pipe.

2. The system of claim 1, wherein the gas is air.

3. The system of claim 1, wherein the gas is natural gas.

4. The system of claim 1, wherein the first reservoir floats in the salt water body.

5. The system of claim 4, wherein the first reservoir further comprises a peripheral wall portion and a floating interface assembly disposed within a volume defined by the peripheral wall portion, wherein the floating interface assembly separates the fresh water from fluid from the salt water body.

6. The system of claim 4, wherein the upper end of the down pipe defines an elevated vessel disposed in the first reservoir and at least in part above the fresh water contained in the first reservoir, and further comprising a pump for pumping fresh water from the first reservoir into the elevated vessel.

7. The system of claim 6, further comprising a controllable valve configured to control the flow of fresh water into the down pipe.

8. The system of claim 1, wherein the compliant pipe is at least one mile long.

9. The system of claim 1, wherein the plurality of spaced-apart support structures each comprises at least two cables that engage the compliant pipe wherein each cable is anchored to the bed of the salt water body.

10. The system of claim 9, wherein the plurality of spaced-apart support structures further comprise at least two buoys, each buoy being fixed to one of the at least two cables.

11. The system of claim 9, wherein the spaced-apart support structures are configured to maintain an average angle of inclination in the compliant pipe of at least three degrees along the length of the compliant pipe.

12. The system of claim 1, wherein the second reservoir is disposed at least one mile from the first reservoir.

13. A fresh water transportation system for transporting fresh water through a body of salt water comprising:

a reservoir containing fresh water;

a first transfer station located in a body of salt water and comprising (i) a first vessel configured to receive fresh water from the reservoir; (ii) a first down pipe having a proximal end and a distal end, and wherein the proximal end is connected to receive fresh water from the first vessel; (iii) a first curved pipe connected to the distal end of the first down pipe and configured to receive fresh water from the first down pipe and to redirect the fresh water to an inclined direction; and (iv) a first compliant pipe connected to the first curved pipe and configured to receive fresh water from the first curved pipe, wherein fresh water in the first compliant pipe is urged through the first compliant pipe due to buoyancy;

a second transfer station comprising (i) a second vessel configured to receive fresh water from the first compliant pipe; (ii) a second down pipe having a proximal end and a distal end, and wherein the proximal end is connected to receive fresh water from the second vessel; (iii) a second curved pipe connected to the distal end of the second down pipe and configured to receive fresh water from the second down pipe and to redirect the fresh water to an inclined direction; and (iv) a second compliant pipe connected to the second curved pipe and configured to receive fresh water from the second curved pipe, wherein fresh water in the second compliant pipe is urged through the second compliant pipe due to buoyancy; and a gas injection system configured to inject a gas into the first curved pipe or into the first compliant pipe.

14. The fresh water transportation system of claim 13, wherein the first curved pipe comprises a plurality of apertures, and further wherein the gas injection system comprises a compressor disposed above the surface of the salt water body, and a plenum that is fluidly connected to the first curved pipe and is fluidly connected to the plurality of apertures, and a flow line connecting the compressor and the plenum.

15. The fresh water transportation system of claim 14, wherein the compressor is powered by the fresh water received by the first vessel.

16. The fresh water transportation system of claim 13, wherein the gas comprises natural gas.

17. The fresh water transportation system of claim 13, further comprising a plurality of spaced-apart support structures configured to support the first compliant pipe along a length of the first compliant pipe, such that the first compliant pipe is disposed at an upwardly angled orientation in the salt water body.

18. The fresh water transportation system of claim 17, wherein the first compliant pipe is disposed at an angle of at least three degrees.

19. The fresh water transportation system of claim 13, wherein the first compliant pipe is at least one mile long.

* * * * *